US007643777B2

(12) United States Patent
Matsumoto et al.

(10) Patent No.: US 7,643,777 B2
(45) Date of Patent: Jan. 5, 2010

(54) TONER CARTRIDGE

(75) Inventors: Takuji Matsumoto, Saitama (JP); Hiromitsu Koizumi, Saitama (JP); Chiharu Nakajima, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/607,952

(22) Filed: Dec. 4, 2006

(65) Prior Publication Data

US 2007/0253748 A1 Nov. 1, 2007

(30) Foreign Application Priority Data

Apr. 27, 2006 (JP) ..... 2006-123926

(51) Int. Cl.
*G03G 15/08* (2006.01)

(52) U.S. Cl. ..... 399/262; 399/263

(58) Field of Classification Search ..... 399/263, 399/262, 258, 120, 119, 27; 222/325, 167, 222/DIG. 1

See application file for complete search history.

(56) References Cited

U.S. PATENT DOCUMENTS 4,281,918 A * 8/1981 Fortmann ..... 399/262
5,091,751 A * 2/1992 Inoue et al. ..... 399/303
5,809,384 A * 9/1998 Johroku et al. ..... 399/262
5,940,658 A * 8/1999 Yokoi et al. ..... 399/119
6,246,848 B1 * 6/2001 Morinaga et al. ..... 399/106
6,324,371 B1 * 11/2001 Okiyama et al. ..... 399/262
6,363,233 B1 * 3/2002 Nakajima ..... 399/120
6,654,569 B2 * 11/2003 Nozawa ..... 399/27
7,043,177 B2 * 5/2006 Kim et al. ..... 399/256
2002/0106215 A1 * 8/2002 Ban et al. ..... 399/120
2006/0013621 A1 * 1/2006 Kimura et al. ..... 399/262

FOREIGN PATENT DOCUMENTS

JP 2000-181224 A 6/2000
JP 2001-42620 A 2/2001

* cited by examiner

*Primary Examiner*—David M Gray
*Assistant Examiner*—Bryan P Ready
(74) *Attorney, Agent, or Firm*—Sughrue Mion, PLLC

(57) ABSTRACT

A toner cartridge can be attached to and detached from an apparatus main body. The toner cartridge includes an outer housing having a substantially rectangular upper cross section and a substantially semi-circular lower cross section, and an inner housing that is disposed inside of a lower portion of the outer housing and that has a cylindrical shape with an opening formed at its side surface, the inner housing being rotatably supported in the lower portion of the outer housing, and at the opening a bridging portion being formed along a longitudinal direction of the inner housing.

40 Claims, 9 Drawing Sheets

TONER CARTRIDGE

BACKGROUND

1. Technical Field

The present invention relates to a toner cartridge, and more particularly, to an image forming apparatus using a charging method in which electric discharge is used as a principle.

2. Related Art

Conventionally, to simplify device configuration and to avoid toner contamination of a toner cartridge mounting section, the following toner cartridges have been widely used.

That is, the toner cartridge includes two containing cases, i.e., a cylindrical inner containing case and an outer containing case which rotatably holds the inner containing case. In a state where the two containing cases are inserted into and fixed to an apparatus, an inner containing case is rotationally operated so that a toner supply opening can be opened and closed.

In the cartridge having the above-described configuration, however, it is required to increase the diameter of the cylindrical portion to increase the maximum toner amount to be filled. Especially in the case of a full color image forming apparatus which requires cartridges of four colors (YMCK), increasing a diameter of the cylindrical portion seriously influence on apparatus size.

SUMMARY

A first aspect of the present invention is a toner cartridge that can be attached to and detached from an apparatus main body including: an outer housing having a substantially rectangular upper cross section and a substantially semi-circular lower cross section, and an inner housing that is disposed inside of a lower portion of the outer housing and that has a cylindrical shape with an opening formed at its side surface, the inner housing being rotatably supported in the lower portion of the outer housing, and at the opening a bridging portion being formed along a longitudinal direction of the inner housing.

BRIEF DESCRIPTION OF THE DRAWINGS

Exemplary embodiments of the present invention will be described in detail based on the following figures, wherein.

DETAILED DESCRIPTION

First, an outline of an image forming apparatus 10 according to the present invention will be explained.

<Basic Configuration>

Figure 1:
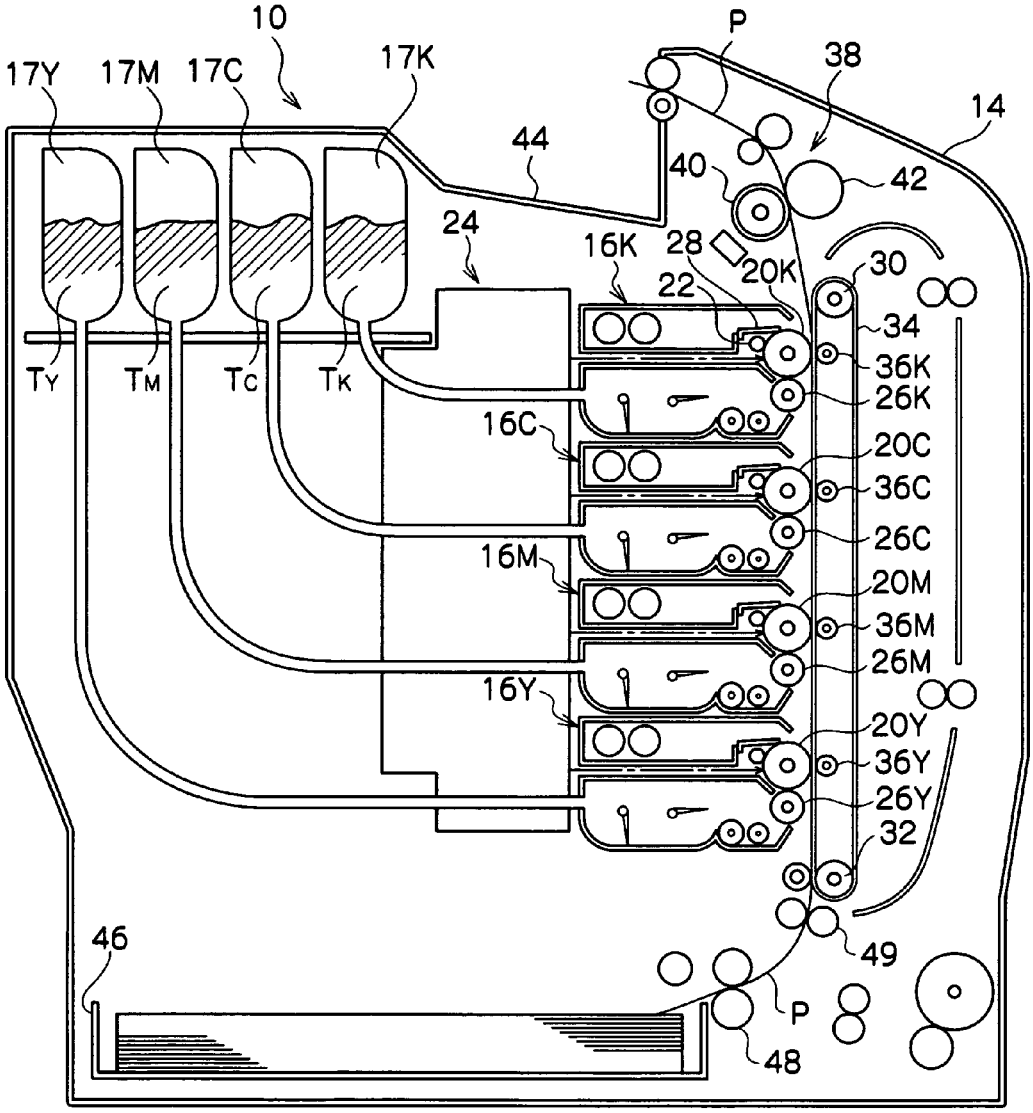
FIG. 1 is a schematic diagram showing an image forming apparatus according to the present invention.
Figure 2:
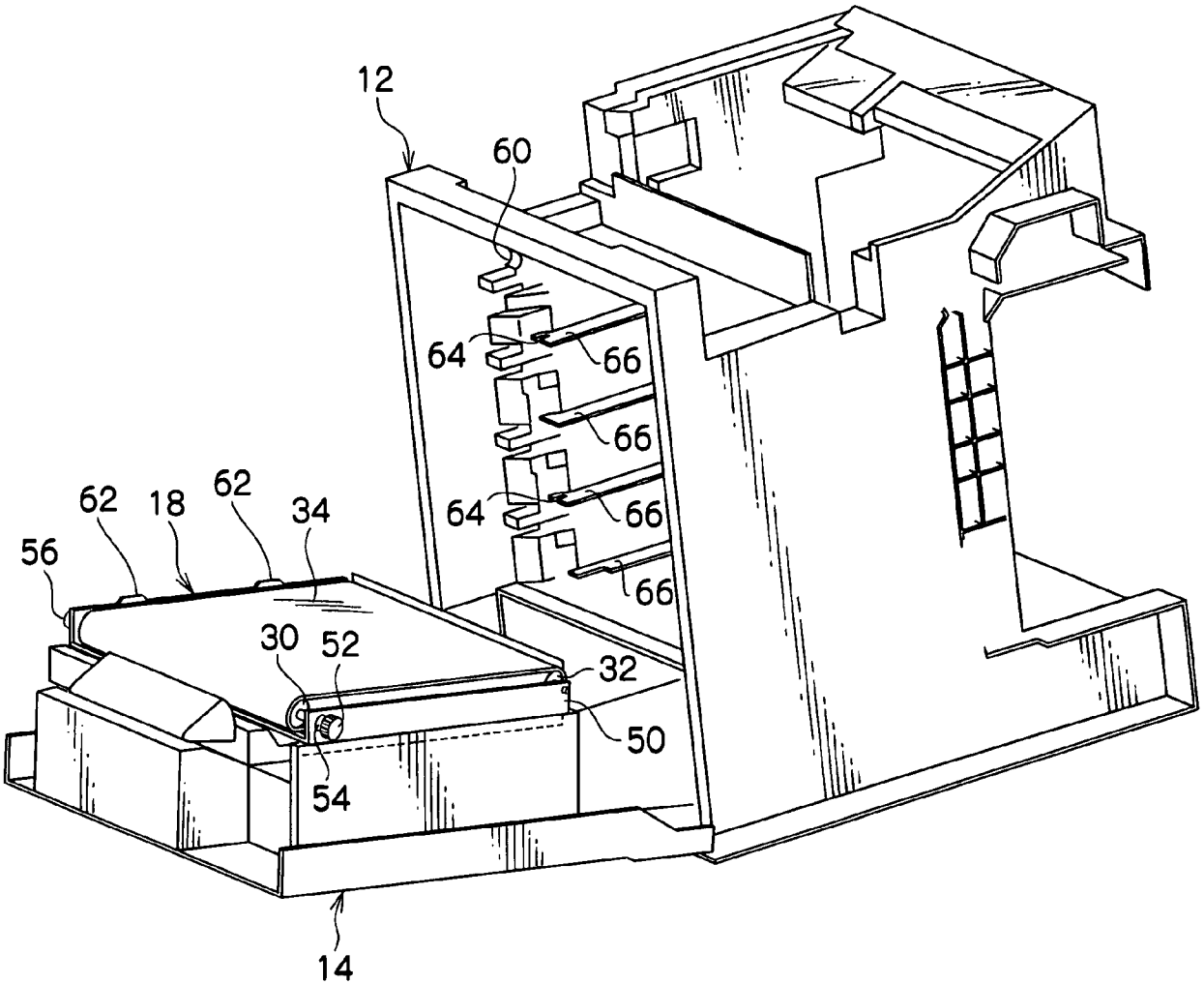
FIG. 2 is a perspective view showing the image forming apparatus of the invention.

FIGS. 1, 2 show a basic configuration of an image forming apparatus of the present invention.

FIGS. 1, 2 show an example of a drum four-color image forming apparatus according to the invention.

As shown in FIGS. 1, 2, an image forming apparatus 10 has a body frame 12 in which image carriers (photoreceptors) 20 (20K, 20C, 20M, 20Y) and developing units 16 (16K, 16C, 16M, 16Y) are detachably contained, and a cover body 14 for opening and closing the image carriers 20 and the developing units 16. A feeding unit 18 having a feeding belt 34, capable of feeding recording sheets P sticking thereto, is detachably mounted on the cover body 14.

Each of the developing units 16 includes a charging roller 22 (22K, 22C, 22M, 22Y) for uniformly charging a surface of the roll-like image carrier 20, an optical box 24 which irradiates the image carrier 20 with image light based on image data to form a latent image by a difference of electrostatic potentials, a developing roller 26 (26K, 26C, 26M, 26Y) which selectively feeds toner to the latent image to make it visible, and a cleaning member 28 which comes into slide contact with the image carrier 20 after the toner image is transferred to clean the toner remaining on the image carrier 20.

The image carrier 20 is provided on its surface (peripheral surface) with a photoreceptor layer. After the surface (peripheral surface) of the image carrier 20 is uniformly charged by the charging roller 22, the surface (peripheral surface) is exposed to laser light (image light) emitted from the optical box 24, the potential of the exposed portion is attenuated, thereby forming an electrostatic latent image (image). The charging roller 22 abuts against the image carrier 20, voltage is applied to therebetween, electricity is discharged in a fine gap near the abutment portion, and thereby the surface of the image carrier 20 is substantially uniformly charged.

The optical box 24 allows flashing laser light to scan a surface (peripheral surface) of the image carrier 20 to form an electrostatic latent image on the surface (peripheral surface) of the image carrier 20 based on the image data. As the optical box 24, luminous elements such as LEDs may be arranged and they are allowed to flash based on the image data.

The developing roller 26 is disposed close to the image carrier 20 such as to be opposed thereto, and developing bias voltage is applied between the developing roller 26 and the image carrier 20. With this, a developing bias electric field is formed between the developing roller 26 and the image carrier 20, and toner having electric charge is transferred to the exposed portion on the image carrier 20 to form a visible image.

The feeding unit 18 includes a feeding belt 34 which is wound around at least a driving roller 30 and a following roller 32. A plurality of (four corresponding to later-described colors) transferring rollers 36 (36K, 36C, 36M, 36Y) are disposed at predetermined distances from one another at predetermined positions between the driving roller 30 and the following roller 32 on inner side of the feeding belt 34.

When the cover body 14 is closed (when the cover body 14 is turned toward the body frame 12 to close the image carrier 20 and the like), the transferring roller 36 is opposed to the image carrier 20 across the feeding belt 34. By forming a transfer electric field between the image carrier 20 and the transferring roller 36, a toner image (non-fixed image) on the surface of the image carrier 20 is transferred onto the recording sheet P which is sucked and fed by the feeding belt 34.

Here, the developing units 16 are disposed in the vertical direction in the order of yellow (Y), magenta (M), cyan (C), black (K) along the feeding direction of the recording sheet P from below so that full color printing can be carried out, and a fixing apparatus 38 is disposed downstream of the developing units 16Y to 16K in the feeding direction of the recording sheet P.

The developing units 16Y to 16K develop electrostatic images on the image carriers 20Y to 20K with toner of yellow (Y), magenta (M), cyan (C), black (K), and then transfers the formed toner image on the recording sheet P.

Since toner Ty to Tk in the developing units 16Y to 16K are consumed by forming toner image, the processing is carried out while maintaining the amount of toner of each colors in the developing units 16Y to 16K by filling toner from the toner cartridges 17Y to 17K suitably.

The fixing apparatus 38 includes a heating roller 40 and a pressing roller 42 whose peripheral surfaces are opposed to each other and which are nipped under predetermined pressure. The heating roller 40 and the pressing roller 42 heat and press a pre-fixed toner image transferred onto the recording sheet P, thereby fixing the toner image on the recording sheet P.

The recording sheet P with the toner image fixed by heating and pressing by the fixing apparatus 38 (heating roller 40 and the pressing roller 42) is discharged on an output tray 44. After the toner image is transferred to the recording sheet P, a surface (peripheral surface) of the image carrier 20 is cleaned by the cleaning member 28 to prepare for a next image forming process.

The body frame 12 is provided at its lower portion with a detachable paper cassette 46. The paper cassette 46 can be pulled out in a direction opposite to a direction where the recording sheet P is sent out, in order to supply recording sheets P suitably.

A pair of paper feeding rollers 48 which sends out recording sheets P one-sheet by one-sheet from the paper cassette 46 is provided in the vicinity of a tip end of the paper cassette 46. The recording sheet P sent out from the pair of paper feeding rollers 48 is sent out to a suction feeding surface of the feeding belt 34 at predetermined timing by a pair of resist rollers 49, and is fed to a transfer position of each toner image of the corresponding color.

In the image forming apparatus 10 of the above-described configuration, the feeding unit 18 detachably mounted on the cover body 14 will be explained in more detail.

The feeding unit 18 includes a substantially rectangular frame-like casing 50. The driving roller 30 is rotatably supported on one end (upper end) of the casing 50, and the following roller 32 is rotatably supported on the other end (lower end). The transfer belt 34 capable of sucking the recording sheet P with electrostatic is wound around the driving roller 30 and the following roller 32.

The transferring rollers 36Y to 36K for each of the colors are disposed at predetermined distances from one another between the driving roller 30 and the following roller 32 on the inner side of the transfer belt 34. The transferring rollers 36Y to 36K are also rotatably supported by the casing 50. When the cover body 14 is closed, the transferring rollers 36Y to 36K nip the image carriers 20Y to 20K under a predetermined pressure, sandwiching the transfer belt 34 to rotate following the running of the transfer belt 34.

<Toner Cartridge>

FIGS. 3A to 6 show the toner cartridge of the image forming apparatus according to the present invention.

Figures 3A, 3B:
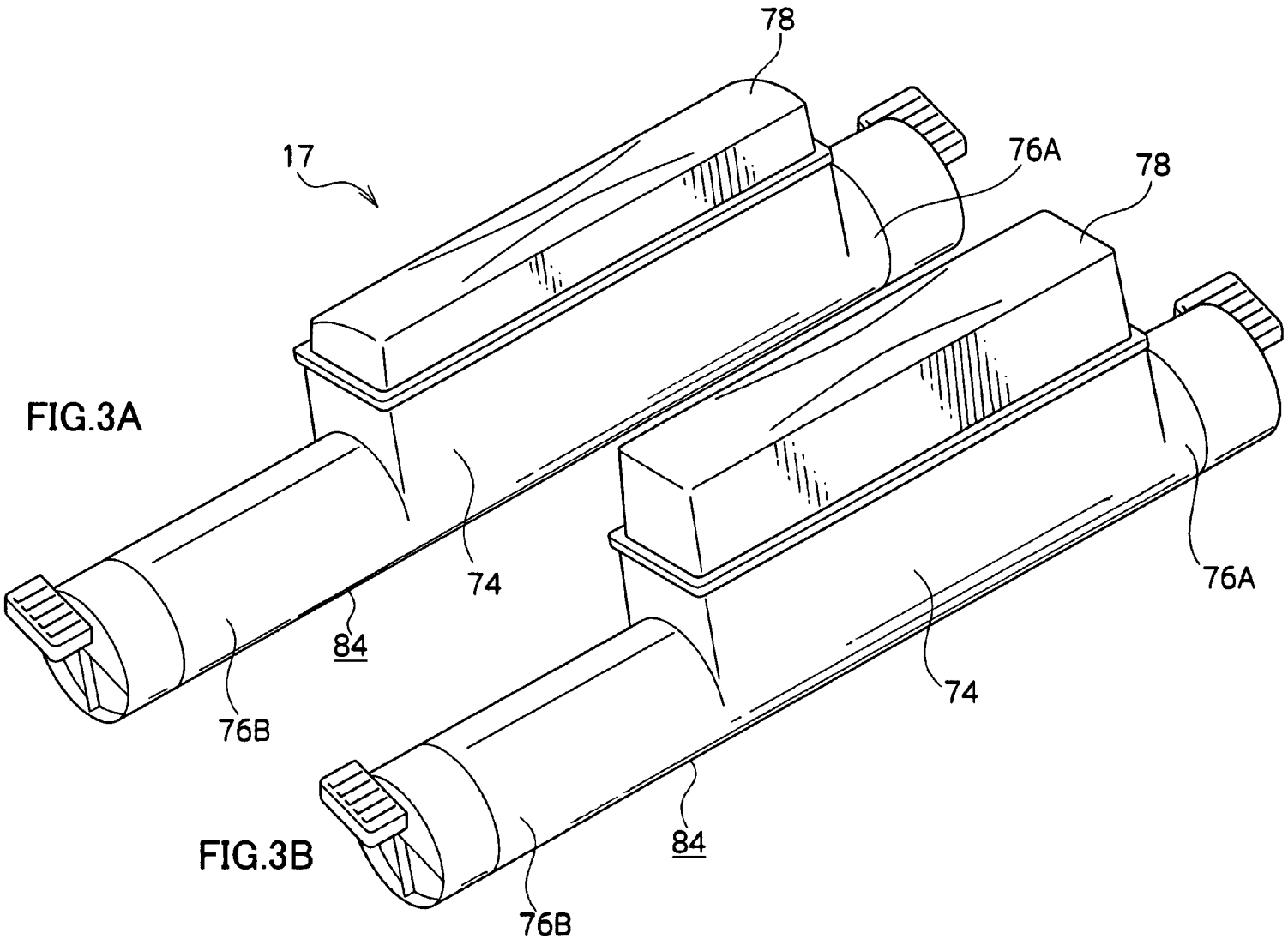
FIGS. 3A and 3B are perspective views showing a toner cartridge of the invention.

The toner cartridge 17 of the present invention includes three blocks, i.e., a central portion 74, and projections 76A and 76B as shown in FIGS. 3A and 3B. An upper portion of the central portion 74 is of substantially square. Lower portions of the cylindrical projections 76A and 76B and the central portion 74 are continuously integrally formed.

The central portion 74 is a space for containing toner T therein. The capacity of the central portion 74 is reduced for toner whose consuming amount is small as shown in FIG. 3A, and the capacity of the central portion 74 is increased for toner whose consuming amount is large as shown in FIG. 3B so as to cope with variation in toner capacity. At that time, if only a size of the cover body 78 constituting the upper portion of the central portion 74 is changed, other portions can be common. Therefore, it is possible to reduce cost while securing the capacity.

Figure 4A:
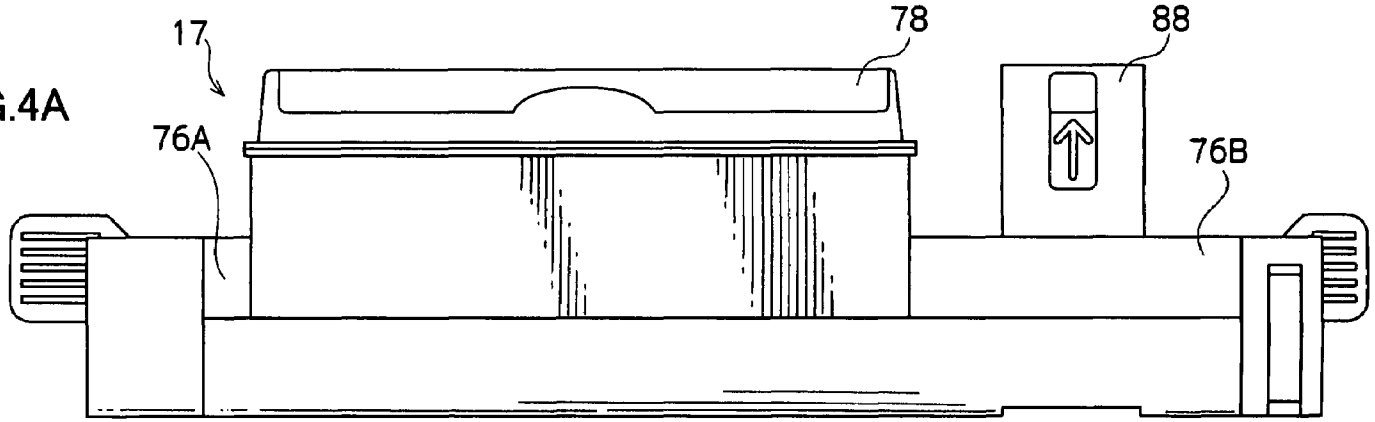
FIGS. 4A and 4B are sectional views showing the toner cartridge of the invention.
Figure 4B:
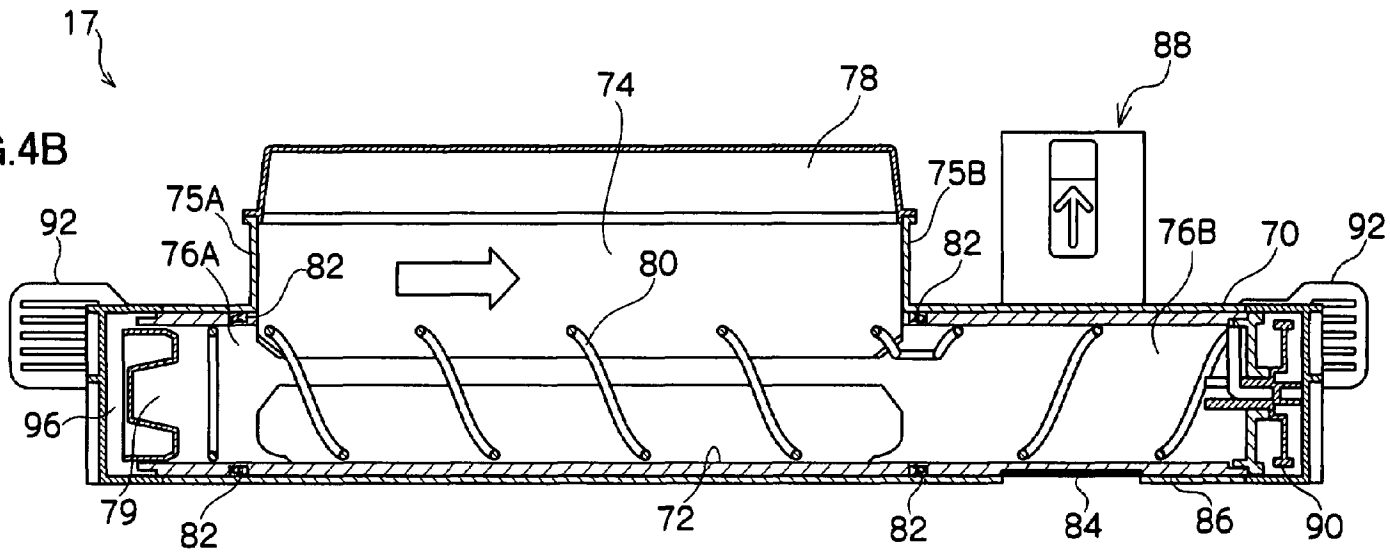

FIGS. 4A and 4B show an outward appearance and an internal configuration of the toner cartridge 17.

As shown in FIG. 4B, the toner cartridge 17 is configured with the substantially cylindrical inner housing 72 fitted into the outer housing 70. A spiral agitator 80 provided in the inner housing 72 rotates the toner T in the central portion 74 by external power through a drive gear 90, thereby feeding the toner T toward a toner supply opening 84 provided in the outer housing 70.

Figure 5:
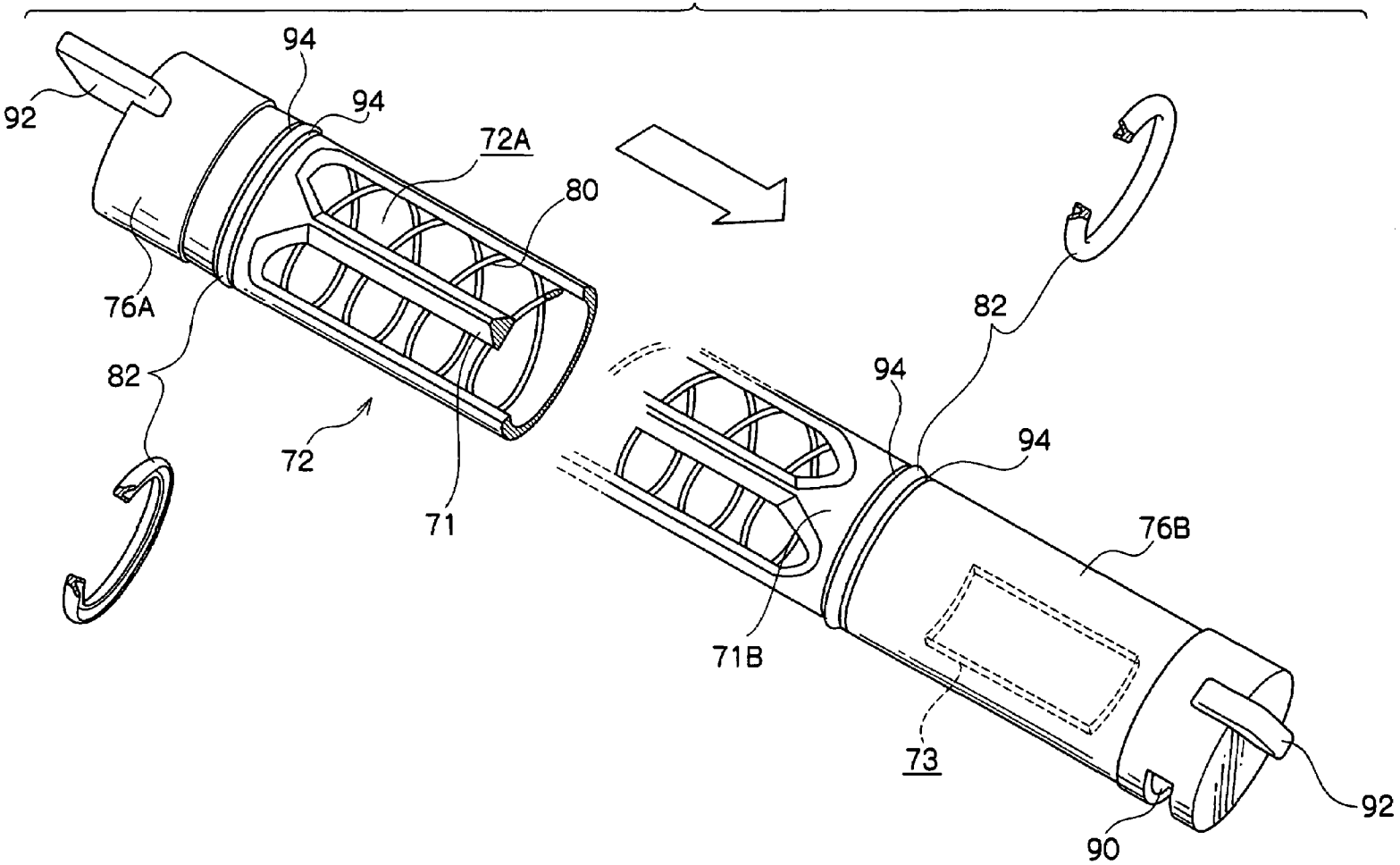
FIG. 5 is a perspective view showing an inner housing of the toner cartridge of the invention.
Figure 6:
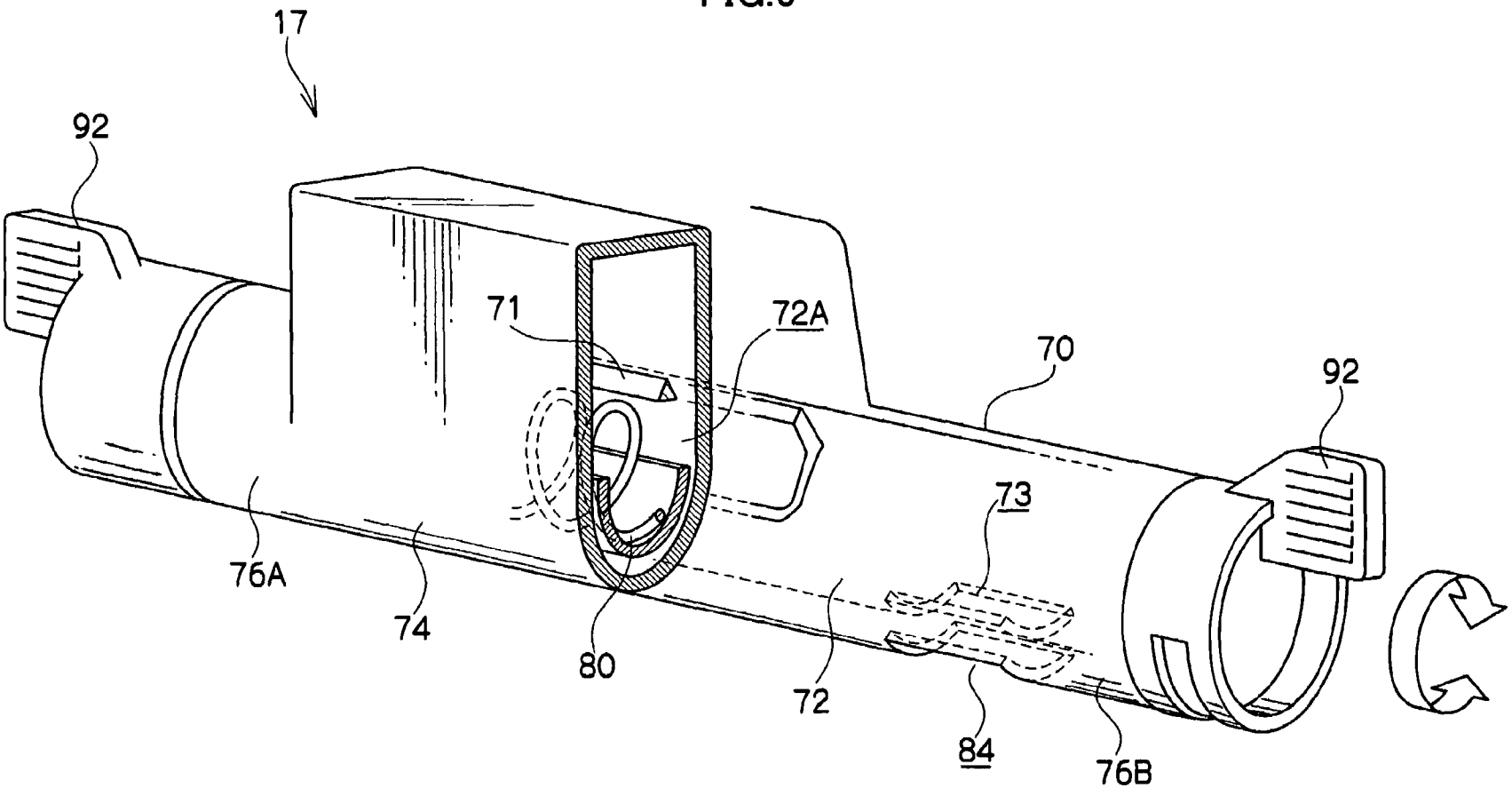
FIG. 6 is a perspective view showing the toner cartridge of the invention.

FIGS. 5 and 6 show the configurations of the outer housing 70 and of the inner housing 72 which is inserted into the outer housing 70.

As shown in FIG. 5, the inner housing 72 is of substantially cylindrical shape. The inner housing 72 feeds toner T in the central portion 74 (see FIG. 4B) of the outer housing 70 from the opening 72A by the agitator 80, and feeds the toner T out from the toner supply opening 73. The position between the outer housing 70 and the inner housing 72 is determined by butting convex portions 94 provided in the inner housing 72 against a butting surface of an inner wall of the outer housing 70 at a position corresponding to boundary walls 75A and 75B of the central portion 74 of the outer housing 70.

As shown in FIG. 5, two of convex portions 94 make a pair and a ring-like V-shaped seal member 82 of V-shaped cross section is formed in a gap between convex portions 94 making a pair. The V-shaped seal member 82 prevents toner T from leaking outside. The V-shaped seal members 82 have the V-shaped cross sections. Opening sides of the V-shaped cross section are opposed to each other to effectively prevent toner T from leaking out. Since the seal member is of the ring-like shape, a nip amount of seal can be secured equally over the entire circumference, and it is possible to reliably prevent toner T from leaking.

The agitator 80 which feeds the toner T is driven by external power through a gear 90. The agitator 80 feeds toner T which is dropped into the inner housing 72 from the opening 72A in a direction shown with a white arrow in the figure, and supplies the toner T from the toner supply opening 73 to the apparatus main body.

The opening 72A is provided with at least one bridging portion 71 in the longitudinal direction. The bridging portion 71 maintains the strength of the opening 72A. The bridging portion 71 has a substantially triangular cross section, and base portions of both ends are thickened in a form of taper and connected to the inner housing 72.

An end 71*b* of the bridging portion 71 is tapered, and connected to the inner housing 72. Therefore, the twisting strength of the bridging portion 71 itself can be enhanced, and is consequently effective for enhancing twisting strength of the inner housing 72 itself.

Since the cross section of the bridging portion 71 is triangular in shape, toner is not deposited on the bridging portion 71 easily, the amount of remaining toner when the use of the toner cartridge 17 is completed can be reduced.

To prevent the inside toner from leaking out at the time of transfer, the inner housing 72 is inserted into the toner cartridge 17 such that the toner supply opening 73 of the inner housing 72 and the toner supply opening 84 of the outer housing 70 are not superposed on each other.

According to the toner cartridge 17 of the present invention, before it is attached, the toner supply opening 73 provided on the inner housing 72 is deviated from the toner supply opening 84 provided in the outer housing 70 and the toner supply opening 73 and the toner supply opening 84 are not in communication with each other. Thus, toner in the central portion 74 of the outer housing 70 does not leak out. The toner supply opening 84 is provided at its both sides with seal members 86, to prevent toner from leaking.

When the toner cartridge 17 is attached to the apparatus main body and toner therein is supplied to the apparatus main body, first, the inner housing 72 is turned in the clockwise direction in the figure by twisting a handle 92 as shown in FIG. 6, the toner supply openings 73 and 84 are brought into communication with each other, and then the inside toner can be supplied to the apparatus main body by the toner supply openings 73 and 84. In this stage, since a heat seal 88 shown in FIG. 4B closes between the toner supply openings 73 and 84, no toner T leaks out.

Next, the toner cartridge 17 is attached to the apparatus main body and then, the heat seal 88 provided on the inner housing 72 is pulled out. With this, the heat seal 88 which has sealed between the toner supply openings 73 and 84 is discharged out from the toner cartridge 17, the toner supply openings 73 and 84 are brought into communication with each other, and the inside toner T is supplied to the apparatus main body from the toner supply openings 73 and 84.

At that time, since the opening 72A is provided vicinity of substantial center in the longitudinal direction of the inner housing 72 and a cross-sectional area of its portion corresponding to the central portion 74 becomes smaller as compared with the both ends, there has been a problem that when the handle 92 is twisted, the twisting strength near the center of the inner housing 72 cannot be maintained.

According to the present invention, the bridging portion 71 is provided in the opening 72A of the inner housing 72. With this it is possible to suppress the deterioration in twisting strength at the time or rotational operation, and to prevent the rotational load from increasing. Therefore, even when the rotational operation handle 92, on the opposite side of the portion near the toner supply opening 73 which receives a rotational resistance by the seal member 86, is held and operated, the rotational load is not increased, and then the operability with one hand can be secured.

A lower portion of the central portion 74 of the outer housing 70 is formed to have a semi-circular cross section shape that is the same shape as lower ends of the projections 76A and 76B. Therefore, when the inside toner is consumed, transport of the inside toner in the longitudinal direction is not hindered, and unnecessary toner residue (increase in residual amount) can be avoided.

<Angle of Opening>

Figure 7A:
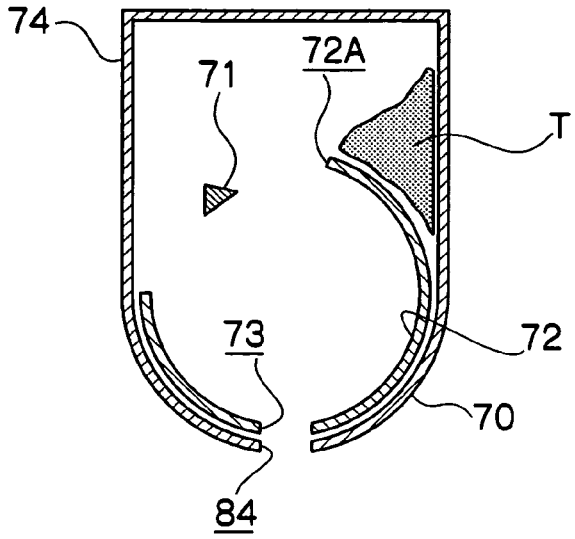
FIGS. 7A and 7B are sectional views showing the configuration of the toner cartridge of the invention.
Figure 7B:
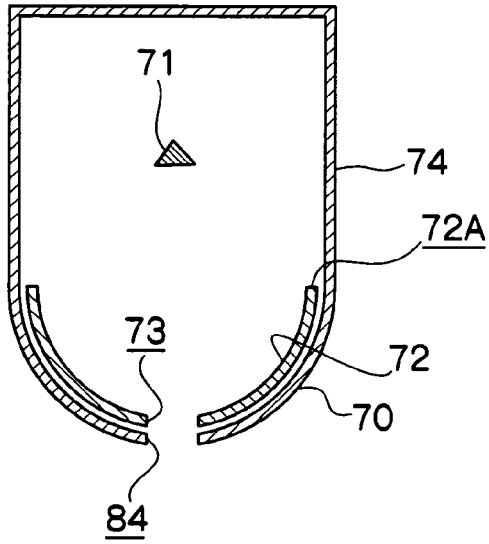
Figure 7C:
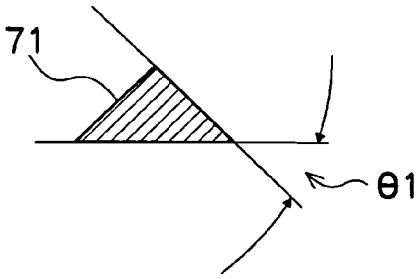
FIG. 7C is a sectional view of a bridging portion of the configuration of the toner cartridge.

FIGS. 7A, 7B and 7C show cross sections of the toner cartridge of the invention.

According to the toner cartridge 17 of the invention, as shown in FIG. 7B, semi-cylindrical portions of the central portion 74, the projection 76A and the semi-cylindrical portion at substantially center of the inner housing 72 in the longitudinal direction are formed into semi-circular shapes such as to fit the shape of the lower portion of the square portion of the outer case, and the opening width (arc width) of the semi-cylindrical portion is set to the diameter of the semi-cylindrical shape, i.e. an opening angle is set to about 180°.

With this, a case where toner is deposited between the inner housing 72 and the inner wall of the outer housing 70 and is not discharged out can be avoided. That is, when the opening width of the opening 72A is not wide enough, toner T is deposited between the inner housing 72 and the inner wall of the outer housing 70 as shown in FIG. 7A, and the toner is not supplied to the apparatus main body and remains.

Whereas, in this embodiment, since the opening angle of the opening 72A is about 180° as shown in FIG. 7B, toner T is not deposited between the inner housing 72 and the inner wall of the outer housing 70 when toner is supplied, and it is possible to prevent toner, which has not been used, from remaining inside and to effectively utilize the entire amount of toner.

Further, as shown in FIG. 7C, the angle θ1 of the slant surface of the bridging portion 71 is set greater than a repose angle of toner to be used, i.e., an inclination angle of a slant surface of the deposited conical shape when toner falls quietly.

The height of the bridging portion 71 in the radial direction (vertical direction in the figure), i.e., the thickness is set to equal to or smaller than the thickness of the inner housing 72 itself.

That is, if the triangular inclination angle θ1 which is a cross section of the bridging portion 71 shown in FIG. 7C is set equal to or greater than a repose angle of the toner to be filled, toner slips off the inclination surface of the bridging portion 71. Therefore, toner is not deposited on the bridging portion 71. And since the thickness of the bridging portion 71 is equal to or less than the thickness of the inner housing 72, the slant surface does not become long, and this is effective for reducing the amount of remaining toner.

<Position of the Bridging Portion>

Figure 8B:
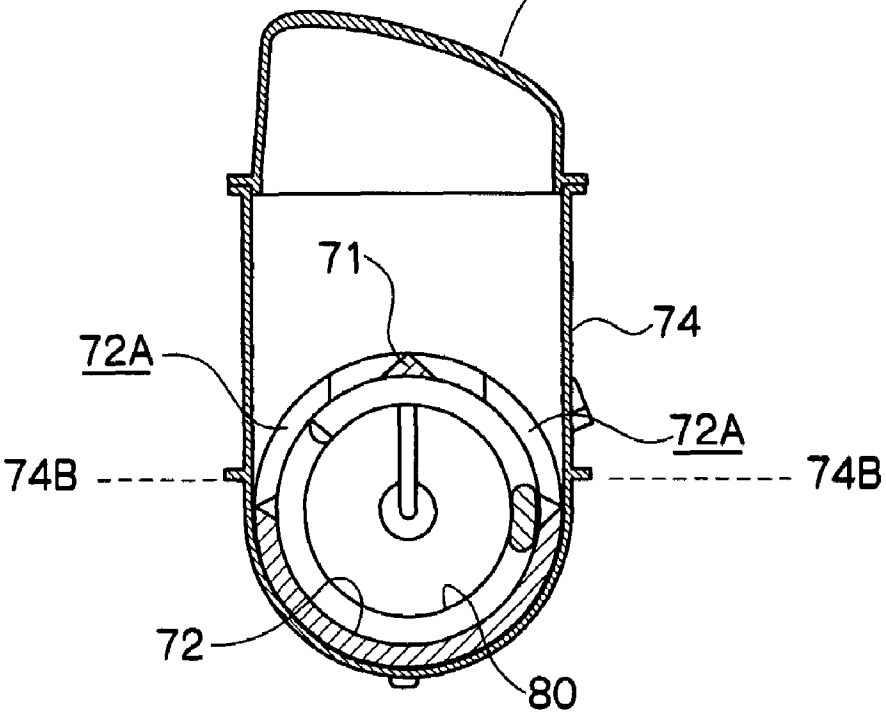
FIGS. 8A and 8B are sectional views showing the toner cartridge of the invention.
Figure 8A:
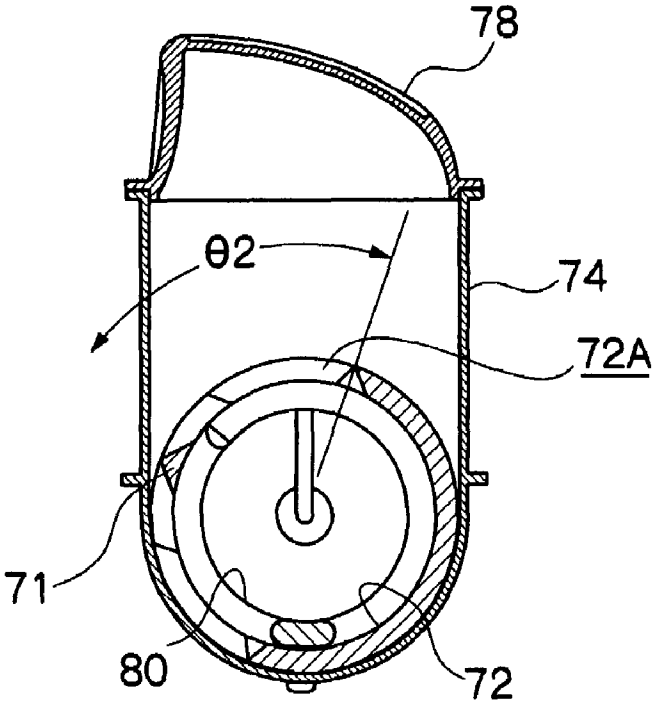

FIGS. 8A and 8B show the cross section of the toner cartridge of the invention.

When toner is filled into the toner cartridge 17, toner is filled from a side of the opening (toner filling opening: e.g., 79) formed at the end of the projection 76A and then, it is fixed and sealed using a cap (e.g., 96) (see FIG. 4B). At that time, as shown in FIG. 8A, in the non-supply position of toner, the bridging portion 71 and the semi-cylindrical inner housing 72 are disposed at positions where an upward projection area of the opening 72A becomes maximum. Therefore, since the opening angle (θ2, in the figure) is utilized most effectively, flow of toner from the projection 76A to the central portion 74 when toner is filled is not hindered, and problems such as increase in the man-hour of the filling operation and the deterioration of the productivity can be avoided.

On the other hand, in the toner supply position where toner is supplied from the toner cartridge 17 to the apparatus main body as shown in FIG. 8B, the bridging portion 71 is disposed at a location most separated from both side walls of the central portion 74 of the outer housing 70 (center in the lateral direction in the figure), the greatest openings (passages) can be secured at both sides of a boundary portion 74B which connects an upper portion and a lower portion of the central portion 74. Therefore, when toner filled into the upper portion of the square portion of the outer case is consumed, toner can move smoothly in the vertical direction (lower side in the figure), and the blocking of toner at the boundary portion 74B can be avoided.

Figure 9:
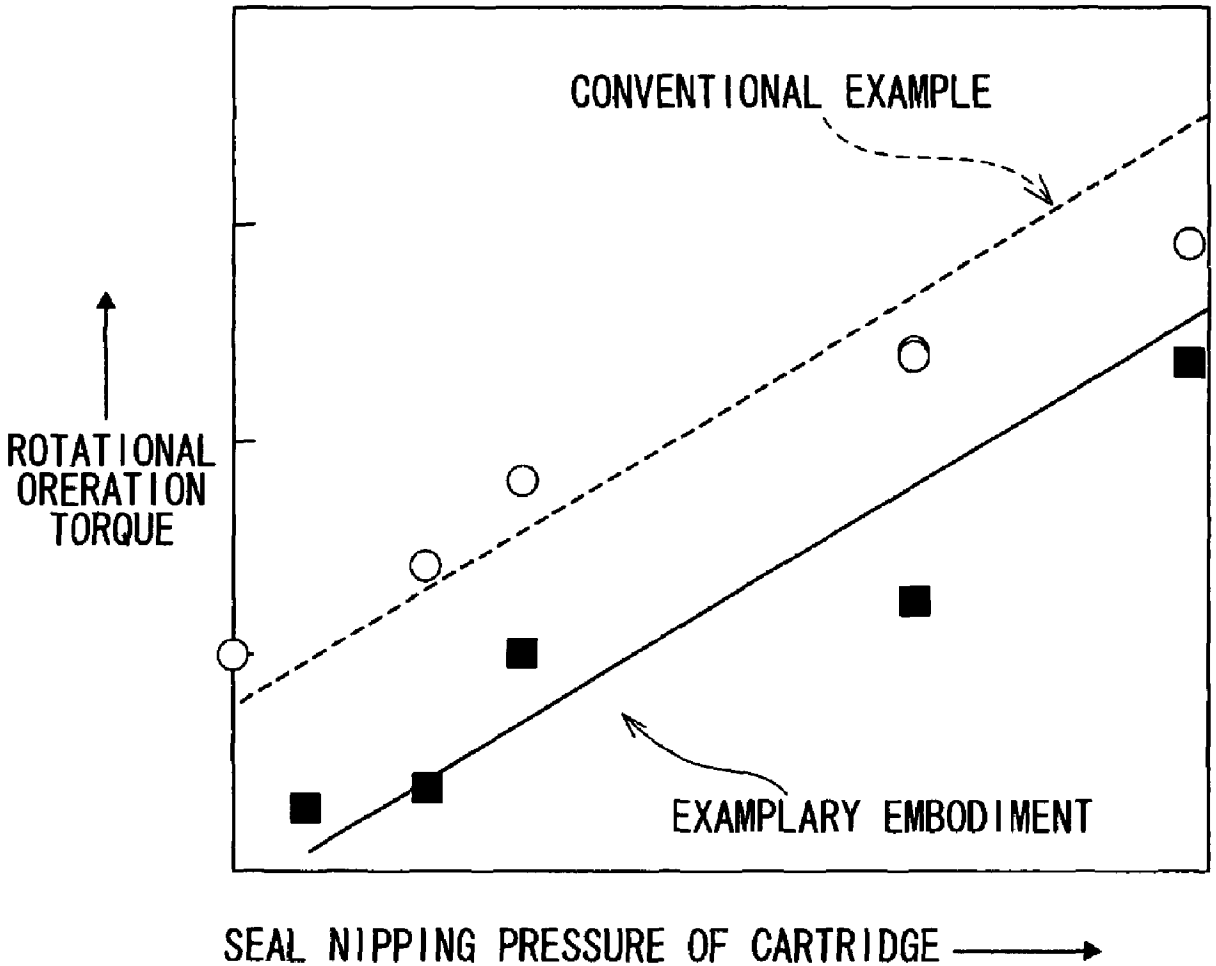
FIG. 9 is a graph showing a rotational operation torque of the toner cartridge when seal abutment pressure is varied.

FIG. 9 shows rotational operation torques of the toner cartridge of the invention and the conventional toner cartridge.

A V-shaped seal member 82 is provided at a predetermined location (shown in FIG. 5) of the inner housing 72, abutment pressure standard of the V-shaped seal member 82 is varied in stepwise, and a rotational operation force when the inner housing 72 is attached and detached is measured using a Push-Pull gauge. The measured position is the operation handle 92 on the side opposite from the toner supply opening 73, and the weight of the filled toner in the toner cartridge 17 is 300 g.

The toner cartridge 17 of the present invention prevents toner from leaking and sealed by the V-shaped seal member 82 provided between the outer housing 70 and the inner housing 72. Therefore, to enhance the sealing ability, the nipping pressure (abutting pressure) of the V-shaped seal member 82 provided on the inner housing 72 against the outer housing 70 should be increased.

However, if the nipping pressure of the V-shaped seal member 82 is increased, the rotational operation force when the inner housing 72 is attached and detached is increased. That is, there is a drawback in that it becomes heavy when the handle 92 is operated. Thus, it is preferable that the set value of the nipping pressure of the V-shaped seal member 82 is increased within a range in which the operability does not deteriorate, so that the sealing ability is secured.

A graph shown in FIG. 7 shows that as compared with a configuration in which the opening 72A is not provided with the bridging portion 71 (conventional example, broken line), in the present invention (solid line) having the bridging portion 71, even when the seal nipping pressure is high, the rotational operation force can be suppressed to a low value, and then it can be found that the twisting strength when the inner housing 72 is operated is enhanced.

The present invention is not limited to the above exemplary embodiment.

For example, although the toner cartridge is for electrophotography in the exemplary embodiment, the invention is not limited to this, and the invention can be applied to other type product as long as fine powder is fed out from a storing container.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner cartridge that can be attached to and detached from an apparatus main body comprising:

an outer housing having a substantially rectangular upper cross section and a substantially semi-circular lower cross section, an inner housing that is disposed inside of a lower portion of the outer housing and that has a cylindrical shape with an opening formed at its side surface, the inner housing being rotatably supported in the lower portion of the outer housing, and at the opening a bridging portion being formed along a longitudinal direction of the inner housing; and ring-like shaped seal members that are provided between the outer housing and the inner housing, the seal members being respectively disposed at both sides of the opening, in a longitudinal direction, of the inner housing;

wherein gaps are formed on the inner housing, and the ring-like shaped seal members are provided at the gaps.

2. The toner cartridge of claim 1, wherein the lower portion of the outer housing is formed with a projection extending in the longitudinal direction, and a lower portion of the projection and the lower portion of the outer housing have substantially the same cross section shapes.

3. The toner cartridge of claim 2, wherein the inner housing has a cylindrical shape along an inner wall of the lower portion of the outer housing and an inner wall of the projection, and the inner housing has a semi-circular cross section in the opening.

4. The toner cartridge of claim 1, wherein the bridging portion is located at the center of both walls of the outer housing when toner is supplied to the apparatus.

5. The toner cartridge of claim 1, wherein the bridging portion is located closest to one of the inner walls of the outer housing when toner is not supplied to the apparatus.

6. The toner cartridge of claim 1, wherein the cross section of the bridging portion is substantially triangular in which a base of the triangular cross section is positioned at an inner periphery side of the inner housing, and a height of the triangular cross section is equal to or less than a thickness of the inner housing.

7. The toner cartridge of claim 6, wherein when the bridging portion is located at the center of both walls of the outer housing, an inclination angle of a side surface of the bridging portion is equal to or greater than a repose angle of rest of the toner.

8. The toner cartridge of claim 1, wherein a base portion of the bridging portion is gradually increased in width in a tapered shape and is connected to the inner housing.

9. The toner cartridge of claim 1, wherein the bridging portion has a length extending in the longitudinal direction of the inner housing and having a width perpendicular to the length, wherein the length of the bridging portion is substantially larger than the width of the bridging portion.

10. The toner cartridge of claim 1, wherein the bridging portion includes a sloped surface to substantially inhibit the depositing of toner on the bridge portion.

11. The toner cartridge of claim 1 wherein, a top portion of the bridging portion forms an acute inclination angle that is substantially equal to or greater than a repose angle of toner.

12. The toner cartridge of claim 1, wherein the ring-like shaped seal members have substantially a V-shaped cross section.

13. The toner cartridge of claim 1, wherein the ring-like shaped seal members having substantially a V-shaped cross section, and opening sides of the V-shaped cross section are disposed so as to be opposed each other.

14. A toner cartridge comprising, an inner housing having a cylindrical surface, the cylindrical surface being formed with an opening through which toner is supplied, the opening being provided with a bridging portion that extends in an axial direction of the cylindrical surface, and the bridging portion connecting edges of the opposed openings, an outer housing rotatably containing the inner housing, and the outer housing having a containing space provided upwards of the inner housing for containing toner, and ring-like shaped seal members that are provided between the outer housing and the inner housing, the seal members being respectively disposed at both sides of the opening, in a longitudinal direction, of the inner housing;

wherein gaps are formed on the inner housing, and the ring-like shaped seat members are provided at the gaps.

15. The toner cartridge of claim 14, wherein a lower portion of the outer housing has a cylindrical surface, the cylindrical surface being complementary to a cylindrical surface of the inner housing.

16. The toner cartridge of claim 14, wherein the containing space has a substantially rectangular cross section.

17. The toner cartridge of claim 14, wherein a lower portion of the outer housing has a projection extending in the axial direction beyond the containing space and a toner supply opening is formed in the projection.

18. The toner cartridge of claim 14, wherein a base portion of the bridging portion is gradually increased in width in a tapered shape and is connected to an edge of the opening.

19. The toner cartridge of claim 14, wherein the bridging portion has a length extending in the axial direction of the cylindrical surface and having a width perpendicular to the length, wherein the length of the bridging portion is substantially larger than the width of the bridging portion.

20. The toner cartridge of claim 14, wherein the bridging portion has a sloped surface to substantially inhibit the depositing of toner on the bridge portion.

21. The toner cartridge of claim 14 wherein, a top portion of the bridging portion forms an acute inclination angle that is substantially equal to or greater than a repose angle of toner.

22. The toner cartridge of claim 14, wherein the ring-like shaped seal members have substantially a V-shaped cross section.

23. The toner cartridge of claim 14, wherein the ring-like shaped seal members have substantially a V-shaped cross section, and opening sides of the V-shaped cross section are disposed so as to be opposed each other.

24. An image forming apparatus comprising:

an image carrier that forms an electrostatic latent image;

a developing unit that develops an electrostatic image on the image carrier with toner;

a toner cartridge that provides the toner to the developing unit, the toner cartridge including an inner housing having a cylindrical surface, the cylindrical surface being formed with an opening through which toner is supplied, the opening being provided with a bridging portion that extends in an axial direction of the cylindrical surface, an outer housing containing the inner housing, and the outer housing having a containing space provided upwards of the inner housing for containing toner, and ring-like shaped seal members that are provided between the outer housing and the inner housing, the seal members being respectively disposed at both sides of the opening, in a longitudinal direction, of the inner housing;

wherein gaps are formed on the inner housing, and the ring-like shaped seat members are provided at the gaps.

25. The image forming apparatus of claim 24, wherein the bridging portion includes a sloped surface to substantially inhibit the depositing of toner on the bridge portion.

26. The image forming apparatus of claim 24, wherein a top portion of the bridging portion forms an acute inclination angle that is substantially equal to or greater than a repose angle of toner.

27. The toner cartridge of claim 24, wherein the ring-like shaped seal members have substantially a V-shaped cross section.

28. The toner cartridge of claim 24, wherein the ring-like shaped seal members have substantially a V-shaped cross section, and opening sides of the V-shaped cross section are disposed so as to be opposed each other.

29. A toner cartridge comprising:

an outer housing that has a first toner supply opening;

an inner housing that is inserted in the outer housing and that has a second toner supply opening, the second toner supply opening being superposed on the first toner supply opening by rotating the inner housing with respect to the outer housing, the inner housing being formed with an opening through which toner is supplied from the outer housing;

a bridging portion being formed at the opening, the bridging portion extending in a longitudinal direction of the inner housing;

an agitator that is disposed in the inner housing and that feeds the toner contained in the inner housing to the second toner supply opening and ring-like shaped seal members that are provided between the outer housing and the inner housing, the seal members being respectively disposed at both sides of the opening, in a longitudinal direction, of the inner housing wherein gaps are formed on the inner housing, and the ring-like shaped seal members are provided at the gaps.

30. The toner cartridge of claim 29, wherein the outer housing has a toner containing space which is opposed to the opening of the inner housing, and the toner containing space has a substantially rectangular section.

31. The toner cartridge of claim 30 wherein the toner containing space includes a cover body.

32. The toner cartridge of claim 29, wherein the bridging portion has a substantially triangular cross section, and a top of the triangular cross section points at the outer housing.

33. The toner cartridge of claim 32, wherein an inclination angle of a side surface of the bridging portion is equal to or greater than a repose angle of the toner contained in the outer housing.

34. The toner cartridge of claim 32, wherein a height of the triangular cross section is equal to or less than a thickness of the inner housing.

35. The toner cartridge of claim 29, wherein the bridging portion has a base portion and a top portion, and the base portion is wider than the top portion and the bridging portion is connected to the inner housing.

36. The toner cartridge of claim 29, wherein the opening has at least two opposing edges and the bridging portion is located at a center of the opening and connects to said opposing edges.

37. The toner cartridge of claim 29, wherein the outer housing has two side walls and the bridging portion is located at a position centered between the side walls of the outer housing in a longitudinal direction when toner is supplied to an image forming apparatus.

38. The toner cartridge of claim 29, wherein the outer housing has two side walls and the bridging portion is located closer to one of the side walls than the other side wall of the outer housing in a longitudinal direction when toner is not supplied to an image forming apparatus.

39. The toner cartridge of claims 29, wherein the ring-like shaped seal members have substantially a V-shaped cross section.

40. The toner cartridge of claim 29, wherein the ring-like shaped seal members have substantially a V-shaped cross section, and opening sides of the V-shaped cross section are disposed so as to be opposed each other.

* * * * *